US005651517A

United States Patent [19]

Stevens et al.

[11] Patent Number: 5,651,517

[45] Date of Patent: Jul. 29, 1997

[54] AUTOMATIC TRAIN SERIALIZATION UTILIZING COMPARISON BETWEEN A MEASURED PARAMETER AND A SYNCHRONIZATION SIGNAL

[75] Inventors: Dale R. Stevens, Adams Center; Anthony W. Lumbis, Watertown, both of N.Y.; Clifford G. Smyrl, St. Paul; Douglas G. Knight, New Brighton, both of Minn.

[73] Assignee: New York Air Brake Corporation, Watertown, N.Y.

[21] Appl. No.: 584,402

[22] Filed: Jan. 11, 1996

[51] Int. Cl.[6] ..... B61L 25/00

[52] U.S. Cl. ..... 246/2 R; 246/4; 246/2 E; 246/167 R; 246/122 R

[58] Field of Search ..... 246/1 C, 2 R, 246/2 E, 4, 6, 7, 122 R, 166.1, 167 R; 340/988

[56] References Cited

U.S. PATENT DOCUMENTS

| | | | |
|---|---|---|---|
| 3,721,820 | 3/1973 | Caulier et al. | 246/247 |
| 4,689,602 | 8/1987 | Morihara et al. | 246/1 C |
| 4,702,291 | 10/1987 | Engle . | |
| 4,825,189 | 4/1989 | Honma et al. | 246/166.1 |

OTHER PUBLICATIONS

A Breakthrough in Trainline Communications, by G.B. Anderson and H.G. Moody, Association of American Railroads for Railway Age, Aug., 1995.

*Primary Examiner*—S. Joseph Morano
*Attorney, Agent, or Firm*—Barnes & Thornburg

[57] ABSTRACT

A method of serialization including providing a parameter which varies along the length of the train and transmitting a synchronization signal along the length of the train to the local nodes at each car. The parameter is measured at each node with respect to the occurrence of the synchronization signal at the node. Serialization of the cars is then performed as a function of the measured parameters. One method is to provide the parameters by transmitting a serial signal which propagates through the train at a slower rate than the synchronization signal and then measuring the difference in time between the receipt of the synchronization and the serial signal at each node. A second method of implementation is to create a pressure gradient in the brake pipe along the length of the train. The brake pipe pressure or flow rate is read at each node upon receipt of the synchronization signal. As a third alternative, an electric load is provided at each node in parallel to a trainline running through the train. The current or voltage of the trainline at each node is then measured upon receipt of the synchronization signal.

34 Claims, 5 Drawing Sheets

AUTOMATIC TRAIN SERIALIZATION UTILIZING COMPARISON BETWEEN A MEASURED PARAMETER AND A SYNCHRONIZATION SIGNAL

BACKGROUND AND SUMMARY OF THE INVENTION

The present invention relates generally to trainline communications and more specifically, to the serialization of cars in a train.

With the addition of electro-pneumatically operated train brakes to railway freight cars comes a need to be able to automatically determine the order of the individual cars in the train. In an EP brake system utilizing a neuron chip or other "intelligent circuitry" a wealth of information is available about the status of each car in the train, but unless the location of the car in the train is known, the information is of little value. It has been suggested that each car report in at power-up. While this will provide information on which cars are in the train consist, it does not provide their location in the consist. Present systems address this issue by requiring that the order of the cars in the train be manually entered into a data file in the locomotive controller. While this does provide the information necessary to properly locate each car in the train, it is very time consuming when dealing with long trains, and must be manually updated every time the train make-up changes (i.e. when cars are dropped off or picked up). The proposed system eliminates the need for manually entering this data by providing the information necessary for the controller to automatically determine the location of each car and EP control module or node in the train.

Historically, there has only been a communication link between one or more of the locomotives in a train with more than one locomotive needed. Current EP systems require a communication link between all cars and locomotives in a train or consist. The Association of American Railroads has selected as a communication architecture for EP systems LONWORKS designed by Echelon. Each car will include a NEURON chip as a communication node in the current design. A beacon is provided in the locomotive and the last car or end of train device to provide controls and transmission from both ends of the train.

The serialization of locomotives in a consist is well known as described in U.S. Pat. No. 4,702,291 to Engle. As each locomotive is connected, it logs in an appropriate sequence. If cars are connected in a unit train as contemplated by the Engle patent, the relationship of the cars are well known at forming the consist and do not change. In most of the freight traffic, the cars in the consist are continuously changed as well as the locomotives or number of locomotives. Thus, serialization must be performed more than once.

Thus, it is an object of the present invention to provide an automatic method of serializing the cars in a train having communication nodes at each car.

Another object of the present invention is to provide a method for each node on a train to determine where it is within the train consist.

These and other objects are achieved by providing a parameter which varies along the length of the train and transmitting a synchronization signal along the length of the train to the local nodes at each car. The parameter is measured at each node with respect to the occurrence of the synchronization signal at the node. Serialization of the cars is then performed as a function of the measured parameters.

One method is to provide the parameters by transmitting a second or serial signal which propagates through the train at a slower rate than the synchronization signal and then measuring the difference in time between the receipt of the synchronization and the serial signal at each node. The synchronization and the serial signal may be transmitted in any order with one beginning the time period and the other ending the time period. This information is used for the serialization. The synchronization and serial signal may be transmitted through two different mediums, for example, the synchronization signal could be an electric signal and the second signal could be a fluid signal transmitted through a brake pipe. The serial signal may be transmitted by a transmitter and the cars moving relative to each other to serially actuate a receiver on each car.

A second method of implementation is to create a pressure gradient in the brake pipe along the length of the train. The brake pipe pressure is read at each node upon receipt of the synchronization signal. The pressure gradient can be created during charging or a pneumatic braking command or resulting from a leak. The measuring of brake pipe pressure can be measured directly at the brake pipe or at a reservoir being charged by the brake pipe. As a further alternative, the flow rate of a charging brake pipe may be measured at each node.

As a third alternative, an electric load is provided at each node in parallel to a trainline running through the train. This creates a current differential along the trainline. The current or voltage of the trainline at each node is then measured upon receipt of the synchronization signal.

Each node measures the parameter at its node and transmits the measurements with an identifier on the network for synchronization. The locomotive determines the position of each node and transmits the node position to the respective node. Also, each node may determine the position of the node relative to the other nodes using the transmitted measurement. The individual nodes compare its measured parameter to the other measured parameters to determine its relative position. This may be achieved by using a first counter for counting the number of node measured parameters transmitted which are either greater or less than the node measured parameter and a second counter for counting the number of node measured parameters. A comparison of the counter in the first counter to the second counter determines the relative position of the node to the total consist.

DETAILED DESCRIPTION OF THE PREFERRED EMBODIMENTS

Figure 1:
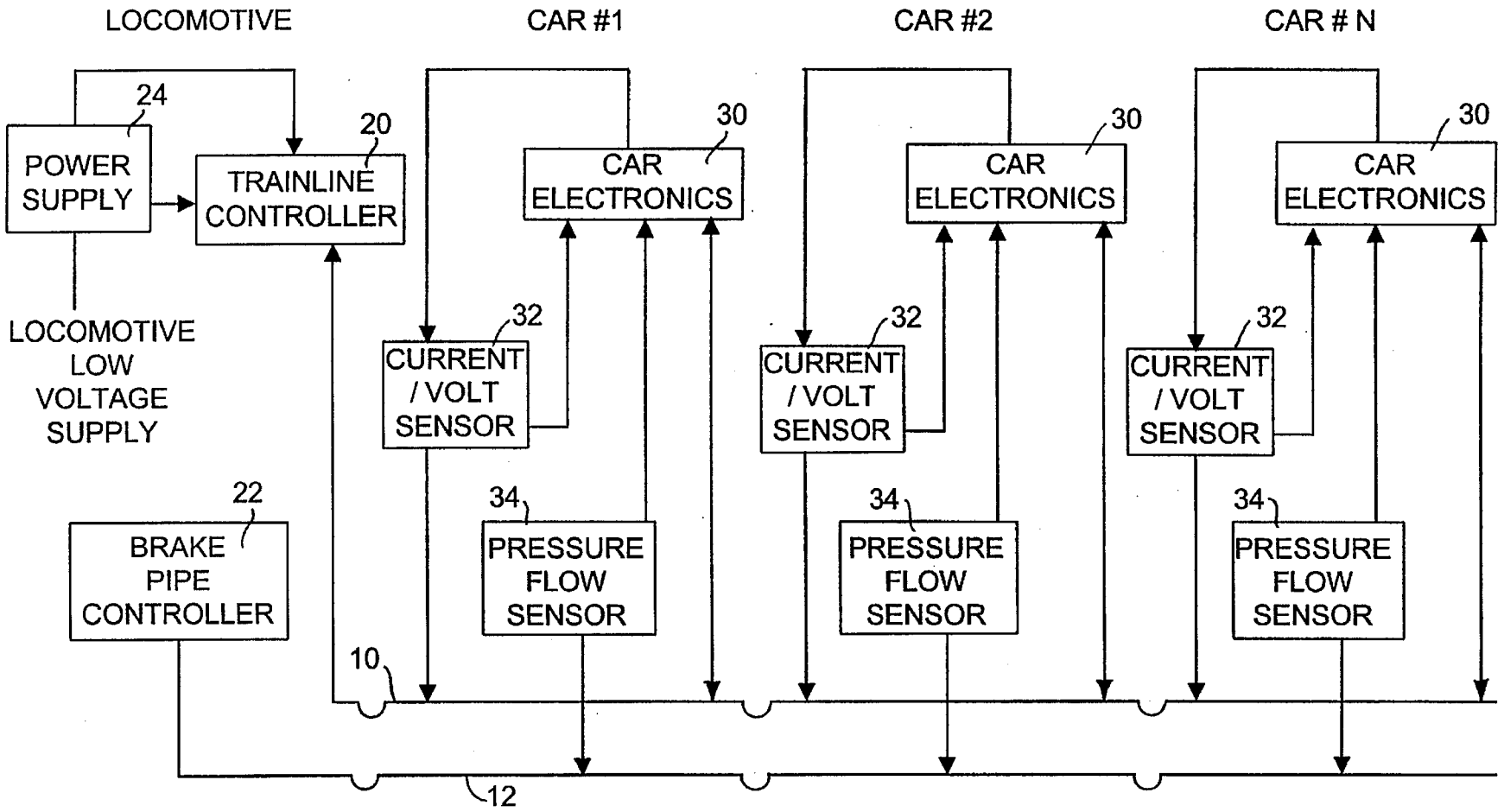
FIG. 1 is a block diagram of a train incorporating electro-pneumatic brakes and a communication system incorporating the principles of the present invention.

A train consisting of one or more locomotives and a plurality of cars is shown in FIG. 1. An electro-pneumatic trainline 10 transmits power and communication to the individual nodes on the cars. A brake pipe 12 provides pneumatic pressure to each of the cars to charge the reservoirs thereon and can fluctuate pressure to apply and release the brakes pneumatically. The locomotive includes a trainline controller 20 which provides the power and the communication and control signals over the EP trainline 10. The brake pipe controller 22 controls the pressure in the brake pipe 12. The power supply 24 receives power from the locomotive low voltage supply and provides the required power for the trainline controller 20 and the EP trainline 10.

Each of the cars include car electronics 30 which are capable of operating the electro-pneumatic brakes as well as providing the necessary communications. As previously discussed, the trainline controller 20 and the car electronics 30 are LONWORKS nodes in a communication network. Car electronics 30 will also provide the necessary monitoring and control functions at the individual cars. With respect to the present serialization method, a current/voltage sensor 32 is connected to the car electronics 30 to sense the current or voltage of the trainline 10 at each node or car. The sensor 32 may be an inductor or any other magnetic field sensor which provides a signal responsive to the current in the trainline 10.

In another embodiment of the present serialization technique, a pressure/flow sensor 34 senses the pressure or flow rate in the brake pipe 12 and provides it to the car electronics 30. As will be discussed, the car electronics 30 measures a variable at its node or car and transmits it along the trainline 10 to the other modules 30 as well to the trainline controller 20.

Figure 2:
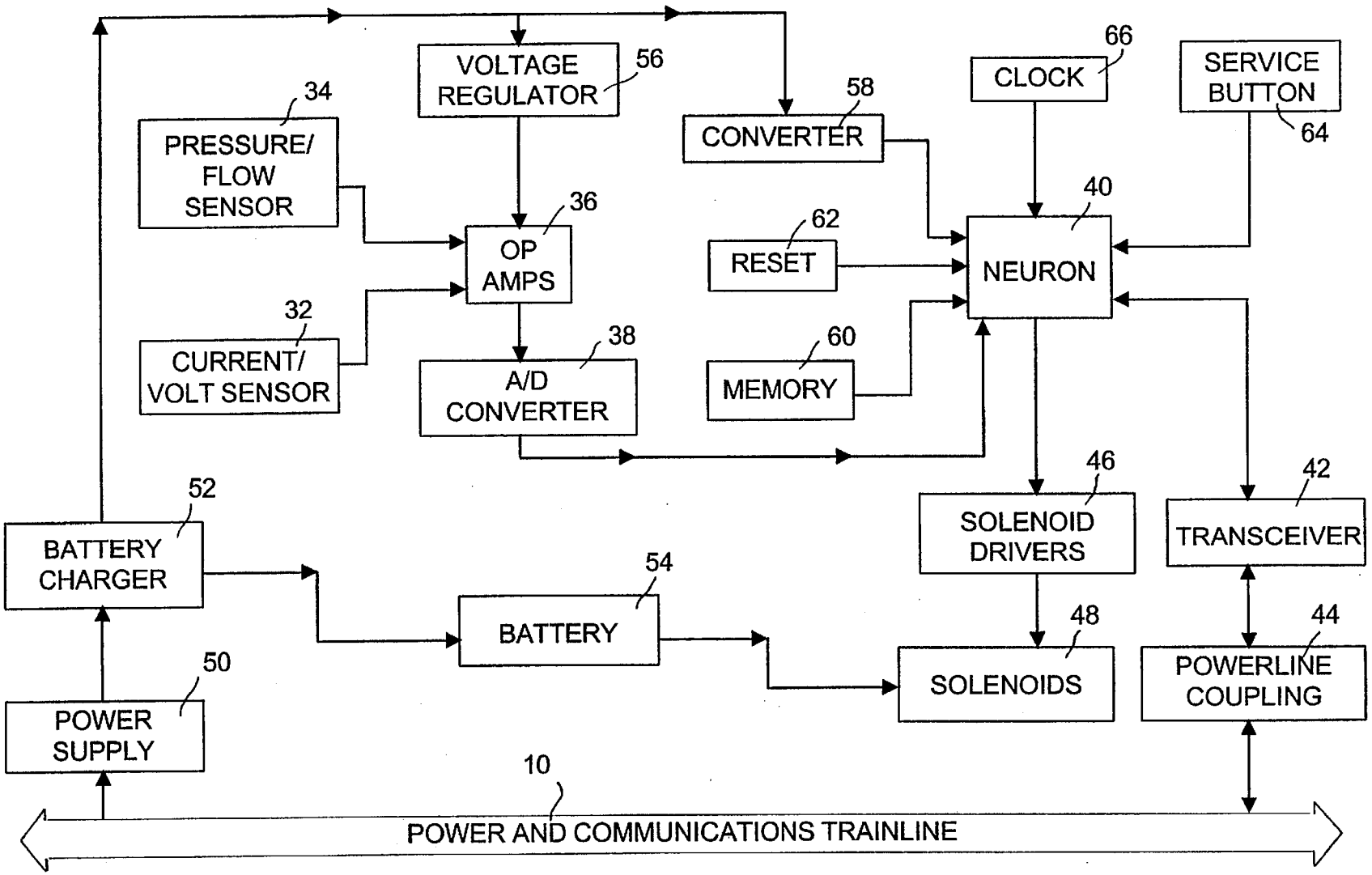
FIG. 2 is a block diagram of the electronics in the individual cars of the train incorporating the principles of the present invention.

A more detailed diagram of the car electronics 30 is illustrated in FIG. 2. A NEURON chip 40 communicates over the trainline 10 via transceiver 42 and power line coupling 44. The electro-pneumatic brakes are under the control of NEURON node 40 via solenoid driver 46 and solenoids 48. A power supply 50 connected to the EP line 10 charges battery 54 through battery charger 52. Also connected to the battery charger 52 are voltage regulator 56 and converter 58. The output of converter 58 is used to power the NEURON chip 40. The current/voltage sensor 32 and the pressure/flow sensor 34 is connected to the NEURON chip 40 by operation amplifier 36 and A/D converter 38. The voltage regulator 56 powers the operational amplifier 36 and the A/D converter 38.

Also connected to NEURON chip 40 is a memory 60, reset circuit 62, service button/sensor 64 and a clock 66. The reset circuitry 62 will reset the node at power up. It may also reset the node in the event of low power conditions. The service button/sensor 64 provides a simple means to test the communication transceiver 42 of the node. Activation of the service button/sensor 64 by manually pressing the button or moving the train relative to an actuator will cause the NEURON chip 40 to send an identification signal via transceiver 42. The trainline controller 20 can then determine the operability of the transceiver 42. Although not preferred, this also provides a means of manually serializing the train by an individual walking down the train and activating the service button 64, one by one. Alternatively, the sensor 64 moving relative to an actuator can also be used for serialization by transmitting a signal serially as they pass each other or to start or stop a timer as will be discussed below. The actuator can be moved relative to a stationary train or the train mover relative to a stationary actuator. The actuator can be any form of signal transmission for light, radio, etc or a reflector of a signal from the car which would be a transmitter and receiver/sensor.

As will be evident from the following description, the present method of serializing the car requires no additional circuitry or connection throughout the train except possibly the current/voltage sensors 32. The pressure sensors 34 are part of the normal monitoring circuitry of the electro-pneumatic brake system.

The present method of serialization provides a parameter which varies along the length of the train. The synchronization signal is transmitted along the length of the train to each of the local nodes of each car. A measurement of the varying parameter at each node is made upon the occurrence of the synchronization signal at each node. The serialization is then performed as a function of the measured parameters. Each of the nodes transmits an identification of the node as well as the measured parameter. This allows the trainline controller 20 to serialize or determine the position of each node within the train as well as allowing the car electronics 30 on each car to determine its position within the train.

One method of providing a parameter which varies along the length of the train is by transmitting two signals of or at different speeds. This may be achieved by sending two different kinds of signals or two signals through two different mediums. For example, a high speed transmission medium could include light, radio waves and electrical signals. A second slower speed signal is also transmitted. This may also include sound, pressure or EMR waves in the brake pipe or even electrical signals over the electrical wires, for example a twisted pair or power lines or the trainline 10. It should be noted that an electrical signal may be considered slow compared to a light signal. The important thing is that they have different times of arrival along the train and that the difference can be measured.

The high speed synchronization signal is transmitted along the train. Sometime shortly thereafter or simultaneously with the high speed synchronization signal, a separate serial signal is propagated along the train to create the varying parameter along the train. The car electronics or nodes 30 along the train measure the time between the reception of the synchronization signal and the serial signal transmitted along the train. This time is recorded and used to determine the order of the cars in the train. The car electronics 30 transmits the time difference with an identification on the trainline 10 to each of the other nodes and to the trainline controller 20. The time difference increases as the position of the car increases along the trainline from the trainline controller 20.

Alternatively, the slow serial signal is transmitted along the train to create the varying parameter along the train and subsequently the high speed signal synchronization is transmitted. In this case the speed of the two signals and the difference in time when they are transmitted preferably are selected such that for the length of the longest train, the high speed signal reaches the end of the train simultaneously or after the slow signal. The important thing is that they have different times of arrival along the train and that the difference can be measured.

As even another alternative, the serial signal which creates the varying parameter may be produced by the train passing a stationary actuator which actuates a sensor, for example service button/sensor 64, on each car serially. This can initiate a time period to be terminated by a subsequent synchronization signal or terminate a period initiated by a previous synchronization signal. The difference in these two signals is measured and use for serialization.

The order of the cars are determined by sorting the identifying message with the difference of time. This will provide the correct order of the cars and the train at the train controller 20. The train controller 20 then transmits the position of each car to its respective NEURON chip 40. Also, each of the cars can determine their own relative position by noting how many messages came in with a shorter time difference than they themselves observed. This corresponds to the number of cars which preceded the current car in the train. Preferably, the car position transmitted by the train controller 20 overrides any car determined relative position determination.

Another way of creating a parameter which varies along the long length of the train is to monitor the brake pipe pressure at each of the nodes at substantially the same time. The brake pipe has a pressure gradient during charging or pneumatic braking. This gradient also exists in a fully charged train, assuming there is a slight leakage in the brake system. Each car measures either its brake pipe pressure or the pressure in the auxiliary reservoir or tank at substantially the same time. This provides a snapshot of the entire train's brake pipe pressure. Cars with higher pressure in the brake pipe are nearer to the charging source which is the locomotive.

During charging, the build up of brake pipe pressure is the serial signal which is being propagated at a very slow rate in the brake pipe. Since the pressure change is slow, it can be frozen in time and the gradient in the pressure can be used to determine the order of the cars. This brake pipe pressure taken at a particular snapshot in time can be used to sort the cars in their position relative to the locomotive as well as relative to each other.

It should also be noted that instead of measuring the brake pipe pressure, a flow meter may be provided in the brake pipe at each node. The cars near to the charging source, which is the locomotive, would see a higher velocity of flow during charging than the cars which are further away.

It should be noted that while the locomotive may be the master node, any of the individual car nodes may alternatively be a master node.

Figure 3:
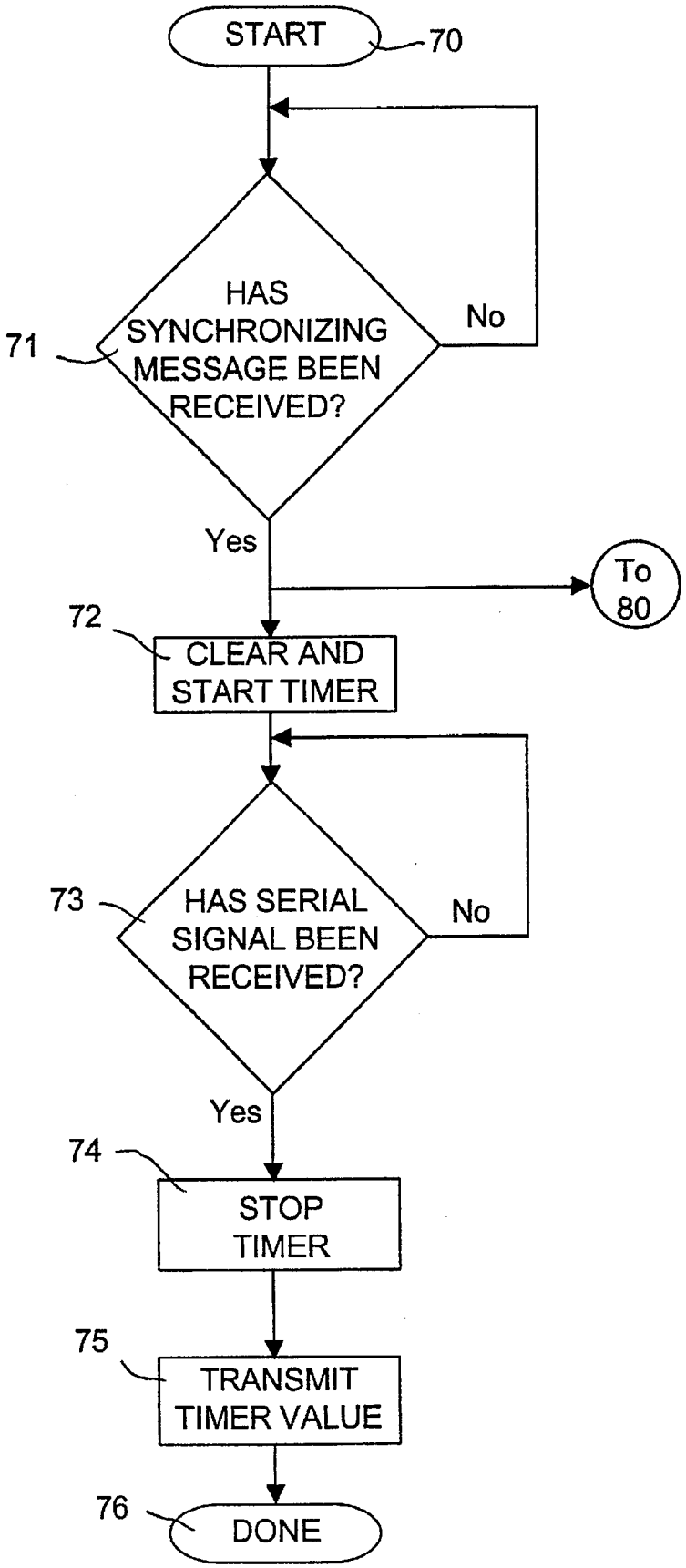
FIG. 3 is a flow chart of the method of serialization according to the principles of the present invention.

Processing the signals wherein the synchronization and serial signal are propagated at two different rates, is illustrated in FIG. 3. The process starts at 70 and a determination made at 71 of whether the synchronization signal or message has been received. If it has not, it is tested again at 71. If the synchronization signal has been received, the timer at each of the nodes is cleared and started at 72. A determination is then made at 73 on whether the serial or the second signal has been received. If not, it is continually retested at 73. Once the serial signal has been received, after the synchronization signal, the timer is stopped at 74. This time value is then transmitted at 75 and the measurement of the parameter at that specific node is completed at 76. As described previously the serial signal may be used to start the counter and a subsequent synchronization signal used to stop the individual counters.

Figure 4:
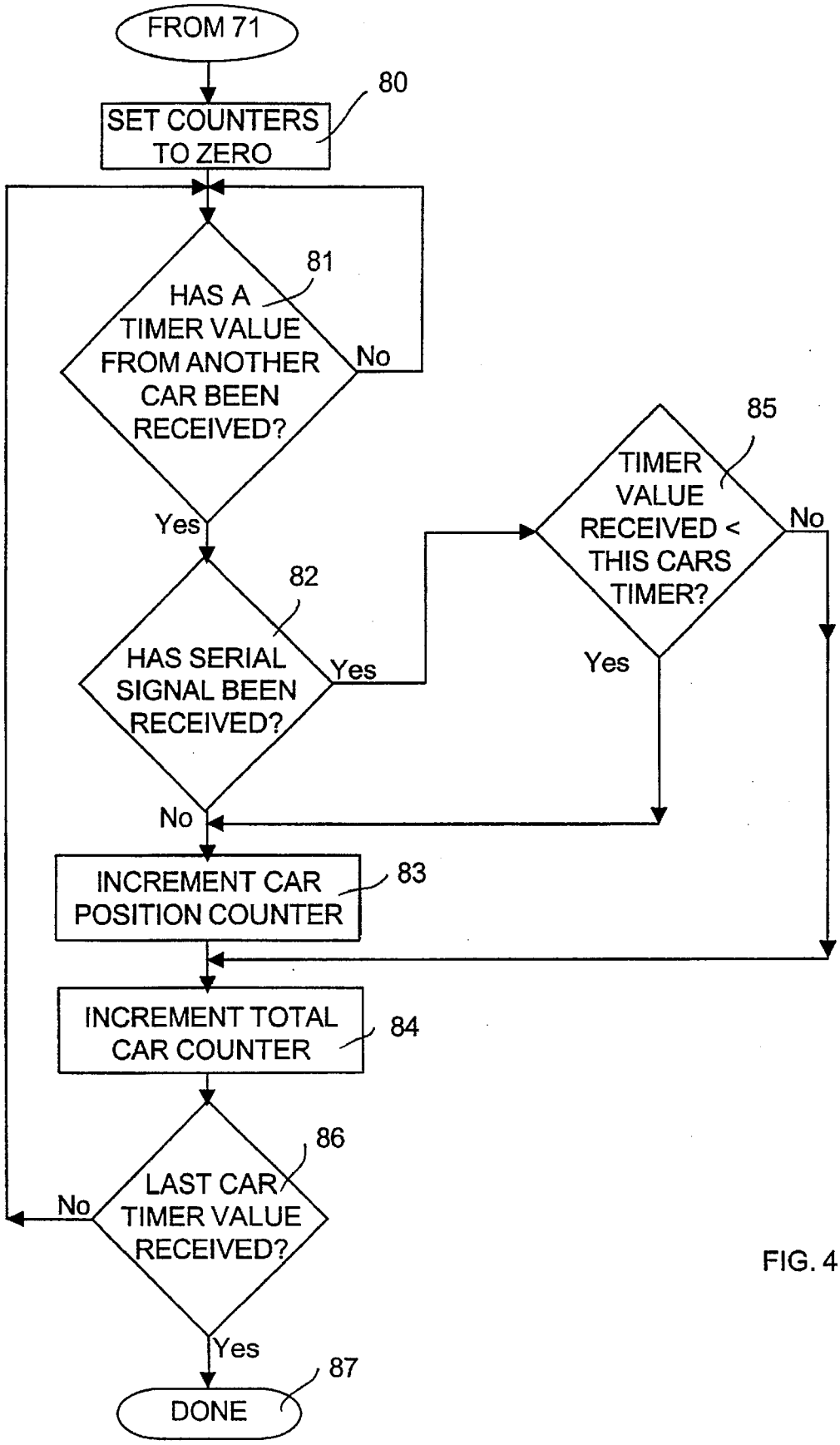
FIG. 4 is a flow chart of the method of each node to determine its position in the train according to the principles of the present invention.

To determine the relative position of the node with respect to the other nodes, the process of FIG. 4 is used. Once a determination that the synchronization signal has been received at 71 in FIG. 3, a counter is set to zero at 80 in FIG. 4. A determination is then made whether a timer value from another car has been received at 81. If not, it is cycled back until timer value has been received from another car.

Next, a determination of whether the serial or second signal has been received by the present car is performed at 82. If not, a car position counter is incremented at 83. Also, a total car count is incremented at 84. If a second or serial signal has been received as determined by 82, then there is a determination at 85 of whether the timer value received is less than the timer value for the present car. If it is less, then the car position counter is incremented at 83 and the total car counter is incremented at 84. If the value is not less than the present car value, then only the total car counter is incremented 84.

After the incrementing of the total car counter 84, there is a determination at 86 of whether the last car timer value has been received. If not, the program is cycled back to determined whether a timer value has been received at 81. If the last car timer has been received, then the sorting of the relative position is completed at 87. Alternatively, a timer may be set and the position determined at a predetermined time after initiation of the timer. This allows each of the individual cars to determine its relative position as indicated by the count in car position counter 83 relative to the remainder of the train as indicated by the count in total car counter 84. Alternatively, two counters can count the number of nodes that have values above and below the present nodes value and add them to get the total count A master controller, for example, the trainline controller 20, can order the cars merely by comparing and sorting the timer values.

Figure 5:
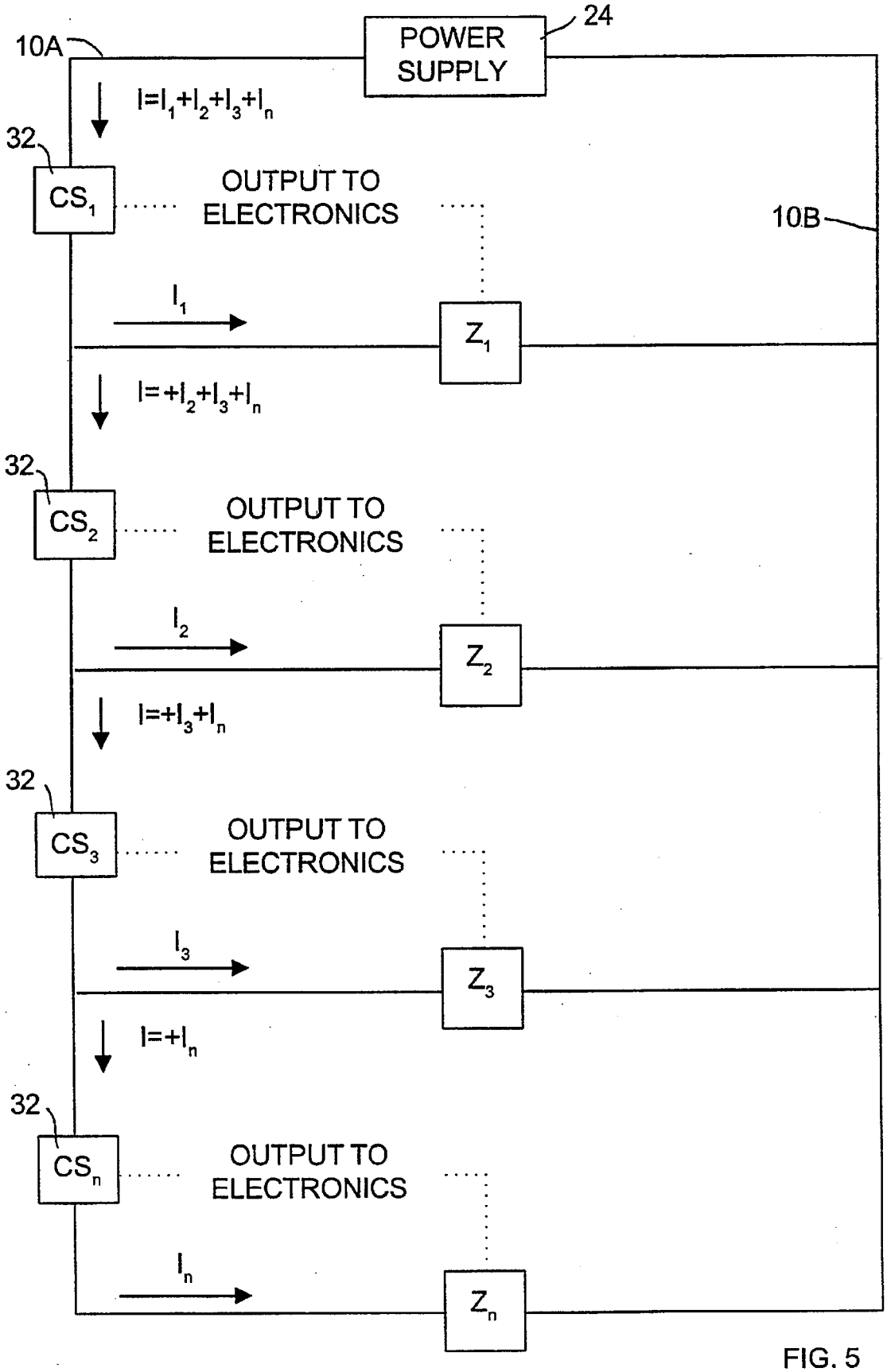
FIG. 5 is an electrical schematic of the current sensing method of the present invention.

Another method of creating a parameter which varies along the length of the train is to take a snapshot of an electrical property of the trainline. This would provide an indication of the relative distance from the power source 24 on trainline 10 by trainline controller 20. As indicated in FIG. 5, each car includes a load Z connected in parallel between lines 10A and 10B of the trainline 10. Trainline 10 may include a pair of lines or a single line 10A with line 10B being a common ground. The current sensors 32, illustrated at each of the cars monitoring the current in the trainline 10A or 10B. Each of the loads Z draws specific current for its car.

Generally, electro-pneumatic modules or car electronics 30 provide a load. If these are not sufficient, a dummy or small fixed load, for example, resistor or light emitting diode may be placed at each junction box or electro-pneumatic control module that requires a small amount of current to be drawn continuously. This would require only a minimal amount of power, approximately 0.2 to 0.50 watts per car. This would provide a highly reliable load at each of the nodes. As is noted in FIG. 5, the current at any node in the train along trainline 10A is a function of its position relative to all the parallel legs or parallel loads.

The basic operation of the system utilizes a current transformer or current sensor 32 located on each car to measure the total current through the trainline wire at each location. Since each car draws a specific amount of current, $I_{Car}$, the total current through the trainline, $I_T$, is equal to the sum of the current drawn by each car. Therefore, the current through the sensor on the first car is $I_T$, the current through the sensor on the second car is $I_T-I_1$, the current through the sensor on the third car is $I_T-I_1-I_2$, etc. Since each car sees progressively less current through the trainline, the output of the current sensor 32 on each car is progressively less. Because of the difference in current in the trainline 10 at each node, the voltage of the trainline 10 at each node will also be different. A voltage sensor could determine the voltage at the node.

This output is then used as an input to the neuron chip 40 located on each car. The value of the voltage generated by the current sensor 32 along with the other pertinent data about that particular car, is then transmitted to the locomotive controller 20 where it can be sorted and stored. By sorting the information supplied to the controller 20 in decreasing order, the order of the cars in the train is determined. The individual cars can determine the relative position from the end of the car by using the method of FIG.

4. Alternatively, the determination at 85 could be those current values greater than the present car's current value for its relative position from the front of the train.

Although the present invention has been described and illustrated in detail, it is to be clearly understood that the same is by way of illustration and example only, and is not to be taken by way of limitation. Any methods may be used to provide a parameter which varies along the train at any point (snapshot) in time or over a period of time. The presently disclosed methods use available systems with minor, if any, modification. The spirit and scope of the present invention are to be limited only by the terms of the appended claims.

What is claimed:

1. In a train including at least one locomotive and a plurality of cars, each car being serially connected to an adjacent car and having a local communication node, and a controller in said locomotive in a network with said communication nodes, a method of serializing said cars comprising:

providing a parameter which varies along the length of said train;

transmitting a synchronization signal along the length of said train to the local node of each car;

measuring said parameter at each node with respect to the occurrence of the synchronization signal at each node; and serializing said cars as a function of said measured parameters.

2. The method according to claim 1, wherein:

providing said parameter includes transmitting a serial signal which propagates through said train at a slower rate than said synchronization signal; and measuring said parameter includes measuring the difference in time between the receipt of the synchronization signal and said serial signal.

3. The method according to claim 2, including transmitting said synchronization signal and said serial signal through two different mediums.

4. The method according to claim 2, wherein said synchronization signal is an electrical signal and said serial signal is a fluid signal transmitted through a brake pipe.

5. The method according to claim 2, wherein said synchronization signal and said serial signal are transmitted in any order.

6. The method according to claim 2, wherein transmitting said serial signal including transmitting said serial signal from a transmitter as the cars and transmitter move relative to each other.

7. The method according to claim 1, wherein:

providing said parameter includes creating a pressure gradient in a brake pipe along the length of the train; and measuring said parameter includes measuring the brake pipe pressure at each node upon the receipt of the synchronization signal.

8. The method according to claim 1, wherein:

providing said parameter includes charging a brake pipe to create said parameter along the length of the train; and measuring said parameter at each node upon the receipt of the synchronization signal during charging.

9. The method according to claim 8, wherein measuring includes measuring the pressure in a reservoir at said node.

10. The method according to claim 8, wherein measuring includes measuring the brake pipe pressure at said node.

11. The method according to claim 8, wherein measuring includes measuring the flow rate in the brake pipe at said node.

12. The method according to claim 1, wherein:

providing said parameter includes providing at each node an electrical load in parallel to a line running the length of the train; and measuring said parameter includes measuring an electrical property of said line at each node upon the receipt of the synchronization signal.

13. The method according to claim 12, including measuring the current of said line at each node upon receipt of the synchronization signal.

14. The method according to claim 12, including measuring the voltage of said line at each node upon receipt of the synchronization signal.

15. The method according to claim 1, wherein each node measures the parameter at its node and transmits the measurement with a node identifier on said network for synchronization.

16. The method according to claim 1, wherein serializing includes, at said locomotive, determining the position of each node and transmitting the position of the node to the respective node.

17. The method according to claim 1, wherein serializing includes, at each node, determining the position of the node relative to the other nodes by comparing its measured parameter to other nodes' measured parameters.

18. In a train including at least one locomotive and a plurality of cars, each car being serially connected to an adjacent car and having a local communication node, and a controller in said locomotive in a network with said communication nodes, wherein:

said controller transmits a synchronization signal along the length of said train to the local node of each car;

each node measures a parameter which varies along the length of said train at each node with respect to the occurrence of the synchronization signal at each node; and each node transmits the measurement with a node identifier on said network for serialization of said cars as a function of said measured parameters.

19. The train according to claim 18, wherein:

said controller transmits a serial signal which propagates through said train at a slower rate than said synchronization signal; and each node measures the difference in time between the receipt of the synchronization signal and said serial signal as said measured parameter.

20. The train according to claim 19, wherein said synchronization signal and said serial signal are transmitted through two different mediums.

21. The train according to claim 19, wherein said synchronization signal is an electrical signal and said serial signal is a fluid signal transmitted through a brake pipe.

22. The method according to claim 19, wherein said synchronization signal and said serial signal are transmitted in any order.

23. The train according to claim 18, wherein:

a transmitter is moved relative to each car to transmit a serial signal serially to each car; and each node measures the difference in time between the receipt of the synchronization signal and said serial signal as said measured parameter.

24. The train according to claim 18, wherein:

said parameter is a pressure gradient in a brake pipe along the length of the train; and each node measures the brake pipe pressure at each node upon the receipt of the synchronization signal as said measured parameter.

25. The train according to claim 18, wherein:

said parameter is a charging brake pipe along the length of the train; and at each node said parameter is measures upon the receipt of the synchronization signal during charging.

26. The train according to claim 25, wherein the pressure in a reservoir at said node is measured as the parameter.

27. The train according to claim 25, wherein the brake pipe pressure at said node is measured as the parameter.

28. The train according to claim 25, wherein the flow rate in the brake pipe at said node is measured as the parameter.

29. The train according to claim 18, wherein:

an electrical load at each node is in parallel to an electrical line running the length of the train; and each node measures an electrical property of said line at each node upon the receipt of the synchronization signal.

30. The train according to claim 29 wherein each node measures the current of said line at each node upon receipt of the synchronization signal.

31. The train according to claim 29 wherein each node measures the voltage of said line at each node upon receipt of the synchronization signal.

32. The train according to claim 18, wherein said controller determines the position of each node and transmits the position of the node to the respective node.

33. The train according to claim 18, wherein each node determines the position of the node relative to the other nodes by comparing its measured parameter to other node measured parameters.

34. The train according to claim 33, wherein each node includes:

a first counter for counting the number of node measured parameters either greater or less than its node measured parameter; and a second counter for counting the number of node measured parameters.

* * * * *